United States Patent [19]

Ohkochi et al.

[11] Patent Number: 4,706,753

[45] Date of Patent: Nov. 17, 1987

[54] METHOD AND DEVICE FOR CONVEYING CHEMICALS THROUGH BOREHOLE

[75] Inventors: Katsutoshi Ohkochi; Mamoru Shinozaki, both of Funabashi; Toshiyuki Ohshita, Hirakata; Masayasu Kitano, Kashihara; Seizo Kamata, Fukuoka, all of Japan

[73] Assignee: Takanaka Komuten Co., Ltd, Japan

[21] Appl. No.: 926,675

[22] Filed: Nov. 4, 1986

[30] Foreign Application Priority Data

| | | | |
|---|---|---|---|
| Apr. 26, 1986 | [JP] | Japan | 61-97563 |
| Apr. 30, 1986 | [JP] | Japan | 61-100525 |
| Jul. 14, 1986 | [JP] | Japan | 61-165396 |

[51] Int. Cl.[4] ..... E21B 33/13

[52] U.S. Cl. ..... 166/286; 166/376; 166/54.6; 166/117; 166/168; 206/601; 220/89 A; 220/277

[58] Field of Search ..... 166/286, 376, 310, 54.5, 166/311, 54.6, 312, 902, 117, 162, 164, 168; 206/524.1, 601; 220/265, 277, 89 A

[56] References Cited

U.S. PATENT DOCUMENTS

| | | | |
|---|---|---|---|
| 2,366,373 | 1/1945 | Voorhees | 166/117 |
| 2,707,520 | 5/1955 | Jordan | 166/117 |
| 2,978,029 | 4/1961 | O'Reilly | 166/117 |

*Primary Examiner*—Stephen J. Novosad
*Assistant Examiner*—Bruce M. Kisliuk
*Attorney, Agent, or Firm*—Franklin D. Wolffe; Morris Fidelman

[57] ABSTRACT

A capsule for conveying chemicals through a borehole for stopping lost circulation has a fragile bottom plate. A weight for destroying the bottom plate is suspended above the capsule by a cord which extends over knife edges. A messenger for cutting the cord is mounted to a wire line. The weight is caused to collide with the messenger to cut the cord, for breaking the bottom plate. Thus, the chemicals are diffused.

13 Claims, 18 Drawing Figures

METHOD AND DEVICE FOR CONVEYING CHEMICALS THROUGH BOREHOLE

FIELD OF THE INVENTION

The present invention relates to means for transporting a certain amount of chemicals through a borehole to a desired depth such that the chemicals are not mixed with drilling mud.

BACKGROUND OF THE INVENTION

Trial pits are formed for purposes of exploration for petroleum, geothermal energy, minerals, etc. Since these pits are as deep as 500 to 5000 m, lost circulation, or lost returns, may take place during a boring operation. If this phenomenon occurs, the drilling mud escapes into the earth through porous sidewalls, making it impossible to retain the head of the drilling mud. This may bring the porous sidewalls to destruction.

In order to plug up the gap that causes such lost circulation, chemicals are supplied to the location of the lost circulation. Originally, a supply pipe was inserted into the ground to supply the chemicals. Specifically, the chemicals are conveyed through the pipe in such a way that drilling mud is followed by the chemicals, thus forming so-called mixed-phase fluid. However, chemicals for stopping lost circulation differ from drilling mud in specific gravity, viscosity, surface tension, and other characteristics. Therefore, when chemicals which are not diffused are employed, they move downward through drilling mud. During this process, the chemicals are not mixed with the drilling mud, nor is a mass of fluid formed. Wrinkles are formed inside the pipe at the rear end. The chemicals move down the pipe while causing the wrinkles to vibrate. Therefore, a small mass is torn out of the mass of fluid at the position of one rear wrinkle. This small mass drifts within the pipe, increasing the area with which the chemicals come into contact with the drilling mud. This is undesirable for the chemicals that should be conveyed without being mixed with drilling mud. Thus, this supply is a wasteful method, and in which it is difficult to pump an almost complete mass of fluid through the pipe to the location of lost circulation.

In an attempt to avoid this problem, i.e., to convey chemicals in the form of a mass to a desired place without reducing the amount of the chemicals, capsules charged with chemicals have been used. These capsules permit chemicals to be transported without being mixed with drilling mud. One method heretofore proposed to diffuse chemicals out of the capsule that has reached the bottom of a hole is to destroy the whole capsule. Another proposed method is to open the valve mounted at the front end of the capsule.

When the former method is adopted, a destruct mechanism such as an explosive is needed, which requires careful handling. Further, porous sidewalls may be destroyed, depending on the destruct mechanism. When the latter method is utilized, it is not assured that the valve at the front end of the capsule is opened with certainty, because of the water pressure inside the hole, the natures of the drilling mud and slime, and other factors.

In addition, boreholes are relatively rarely vertical. Some boreholes are inclined at 30° or 45°. Also, porous sidewalls are not flat but rough. Accordingly, in order to allow the capsule to drop smoothly, the capsule must have a self-guiding function. At depths of hundreds to thousands of meters, a gap is produced between members of different kinds of the capsule because they are caused to expand or contract by high temperature and high pressure. As a result, after the capsule is used only once, a distortion may be produced, or the contact portions of members may be damaged. This makes it impossible to repeatedly use the capsule.

SUMMARY OF THE INVENTION

Accordingly, it is an object of the invention to provide a method of conveying chemicals to any desired depth without destroying the porous sidewalls of a borehole.

It is another object of the invention to provide a capsule adapted for the conveyance of chemicals as described in the previous paragraph.

The capsule according to the invention is charged with chemicals and consists of a cylinder having a bottom plate which is made from a fragile material such as glass, ceramic, or reinforced cloth. A weight for destroying the bottom plate is suspended by a cord above the cylinder. Knife edges protrude from a cutting base formed around a wire line by which the cylinder is suspended. The cord is so fastened that it extends over the knife edges. A messenger for cutting the cord is mounted to the wire line. The messenger is let down to a desired position in the borehole. Then, the weight is caused to act on the bottom plate via the messenger, for diffusing the chemicals.

Other objects and features of the invention will appear in the course of the description thereof which follows.

DETAILED DESCRIPTION OF THE INVENTION

Figure 1A:
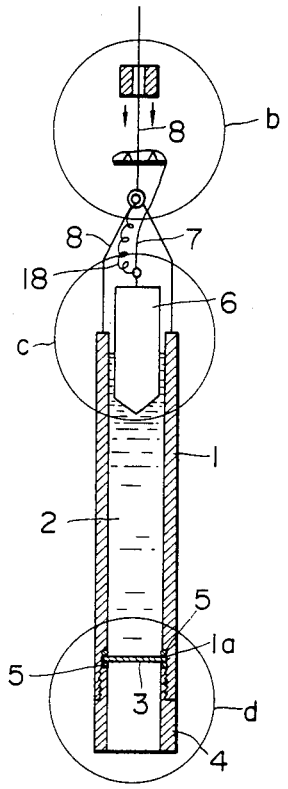
FIG. 1A is a schematic cross section of a capsule according to the invention.

Referring to FIG. 1A, there is shown a capsule embodying the concept of the present invention. This capsule comprises a cylinder 1 that acts as a container charged with chemicals 2 for stopping lost circulation, or lost returns. The cylinder 1 has a bottom plate 3 made from a fragile material, such as glass, ceramic, or reinforced cloth. The bottom plate 3 is formed independently of the cylinder 1. The hollow inside of the cylinder 1 has an enlarged portion 1*a* near its lower end. When the bottom plate 3 is mounted to the cylinder 1, a short threaded cylinder 4 is screwed to the enlarged portion 1*a* of the cylinder 1. The short cylinder 4 forms the front end portion of the cylinder 1 to secure a path along which chemicals 2 from the bottom plate 3 are discharged. An O ring 5 is interposed between the enlarged portion 1*a* and the threaded cylinder 4 to form a seal.

Figure 1B:
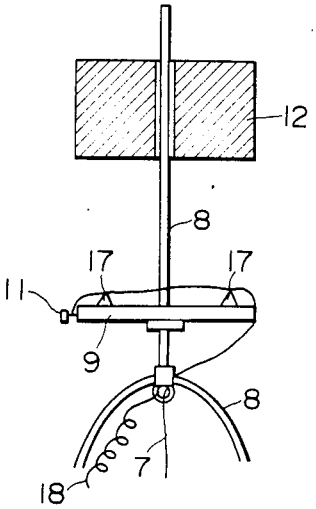
FIG. 1B is an enlarged view of the portion surrounded by line b of FIG. 1A.

A weight 6 for destroying the bottom plate 3 is suspended by a cord 7 above the bottom plate 3. The position of the weight 6 is so set that it can drop a certain distance. The cylinder 1 is suspended by a wire line 8 to which a cutting base 9 is rigidly fixed so as to form a jaw, as shown in FIG. 1B. Knife edges 17 are mounted on the base 9. The cord 7 extends over the knife edges 17, and is affixed to one side surface at 11.

A cylindrical messenger 12 is centrally provided with a hole through which the wire line 8 extends. When the messenger 12 falls along the wire line 8 from the opening of a drilled hole, it collides with the knife edges 17, cutting the cord 7. Then, the weight 6 drops toward the bottom plate 3, destroying it. As a result, the chemicals are diffused into the hole. A cord 18 is provided to prevent the weight 6 from dropping further after it destructs the bottom plate. If the weight 6 were left behind in the hole, then the grinding edge of the excavator would be damaged by the weight 6.

When the capsule constructed as described above is suspended inside the hole and put into work at the location of lost circulation, porous sidewalls are not destroyed by explosion. Also, the diffusion of the chemicals are not affected by the environmental conditions outside the capsule, such as water pressure, drilling mud, slime, etc. Hence, the diffusion is assured. Further, after the capsule 1 is recovered, a new bottom plate 3 can be mounted for reuse. Therefore, the cost can be curtailed.

The cylinder 1 is made from a heat-resistant material such as steel or glass fiber-reinforced fabric (FRP), but if it should fall into the hole by accident, it would be left in the hole, hindering drilling operation. For this reason, the cylinder should not be made from steel that is difficult to destroy. Where the inside of the borehole is at room temperature or at a relatively low temperature less than 100° C., the cylinder can be made from polyvinyl chloride (PVC). Where the temperature is high, i.e., in excess of 100° C., the cylinder should be made from FRP or the like.

Since the cylinder 1 and the short threaded cylinder 4 are in contact with each other, they are made from the same material to avoid problems which would otherwise be caused by the aforementioned expansion or contraction difference.

Referring further to FIG. 1A, the weight 6 is loosely inserted in the upper opening of the cylinder 1. Thus, the chemicals 2 are not isolated from external drilling mud through the gap. Therefore, the pressure inside the cylinder 1 is automatically balanced against the outside pressure. Hence, destruction due to pressure difference does not take place. However, if the chemicals 2 react with water, the inside of the cylinder should not be in direct communication with the outside. This can be achieved by the structure shown in FIG. 1C.

Figure 1C:
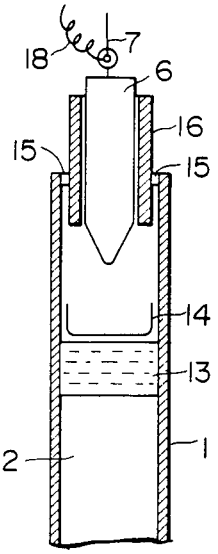
FIG. 1C is a view of a modification of the portion surrounded by line c of FIG. 1A.

Referring next to FIG. 1C, the chemicals 2 are isolated from the drilling mud by a liquid spacer 13, such as solvent, and a heat-resistant filmy spacer 14, such as aluminum foil, placed above the liquid spacer 13. In this case, the weight 6 must be placed in an upper position. For this purpose, an arm 15 is mounted in the upper opening of the cylinder 1 and holds a guide pipe 16 in which the weight 6 is mounted.

Figure 1D:
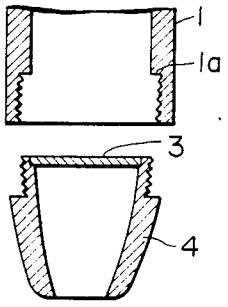
FIG. 1D is a view of a modification of the portion surrounded by line d of FIG. 1A.

Referring to FIG. 1D, there is shown another example of cylinder 1. This cylinder 1 is shaped so as to taper off, in order that the chemicals be guided by the cylinder when it falls down the hole.

Figure 2A:
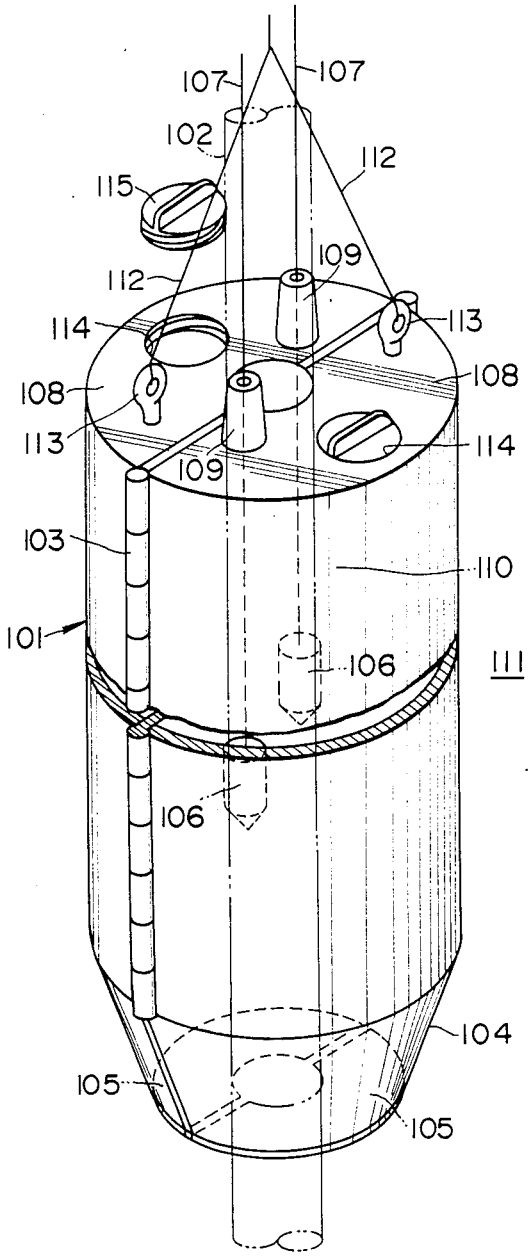
FIG. 2A is a partially cutaway perspective view of another capsule according to the invention.
Figure 2B:
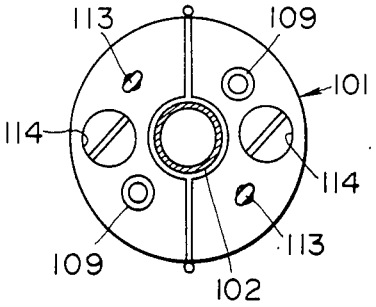
FIG. 2B is a plan view of the top cover of the capsule shown in FIG. 2A.

Referring to FIG. 2A, there is shown a still other capsule according to the invention, the capsule being charged with chemicals for stopping lost circulation. The capsule, generally indicated by reference numeral 101, is mounted on a drilling rod 102 so as to embrace the rod as shown. The capsule is annular in cross section, and is vertically divided into two sections which are coupled together with pins 103. The capsule 101 can drop through a drilled hole while guided by the rod 102. A bottom plate 105 mounted at the bottom 104 of the capsule preferably tapers off to reduce the resistance that the capsule encounters when it falls down the hole. The bottom plate 105 is made from a fragile material, such as glass. A weight 106 which, when allowed to drop, acts to destroy the bottom plate 105 is suspended by a cord 107 above the bottom plate 105. The capsule has a top cover 108 provided with openings 109 for balancing purposes. The cord 107 extends outwardly of the capsule 101 through the openings 109. These openings 109 permit the chemicals 110 inside the capsule and liquid 111, or drilling mud, inside the hole to come into contact with each other. In this way, the pressure inside the pressure is balanced against the outside pressure. If a pressure difference were created, a destruction might take place. When the chemicals 110 react with water, the size of the openings 109 should be minimized to reduce the reaction to a minimum.

The top cover 108 of the capsule further has holding elements 113 to which a wire line 112 is anchored. Also, the cover 108 is formed with openings 114 through which chemicals are entered. The openings 114 are covered by caps 115 (only one is shown). In the illustrated example, the capsule 101 is fabricated as a unit.

Figure 2C:
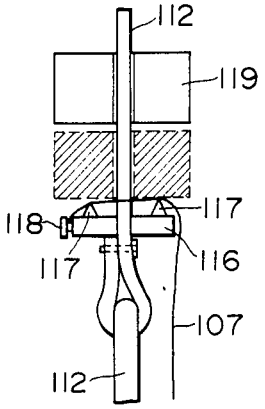
FIG. 2C is a front elevation of the cutting base rigidly fixed to the wire line of the capsule shown in FIG. 2A.

As shown in FIG. 2C, a cutting base 116 is rigidly fixed to the wire line 112 so as to form a jaw. Knife edges 117 are mounted on the jaw. The cord 107 extends over the knife edges 117, and is affixed to one side of the base at 118. Each cylindrical messenger 119 is centrally provided with a hole through which the wire line 112 extends. When the messenger 119 falls along the wire line 112 from the opening of the borehole, it takes the position indicated by the dot-and-dash line and collides with the knife edges 117, cutting the cord 107. Then, the weight 106 drops to the bottom 105, destroying it. Thus, the chemicals 110 are diffused in the hole. A cord (not shown) is provided to prevent the weight 106 from falling further.

Figure 3A:
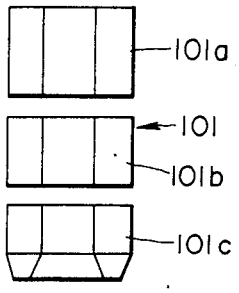
FIG. 3A is a diagram for illustrating the manner in which the capacity of a capsule is increased by a multistage configuration, depending on the scale of lost circulation.

When it is desired to convey an increased amount of chemicals according to the scale of lost circulation, the capsule 101 can consist of a plurality of units 101*a*, 101*b*, 101*c*, as shown in FIG. 3A. That is, a multistage configuration is built.

Figure 3B:
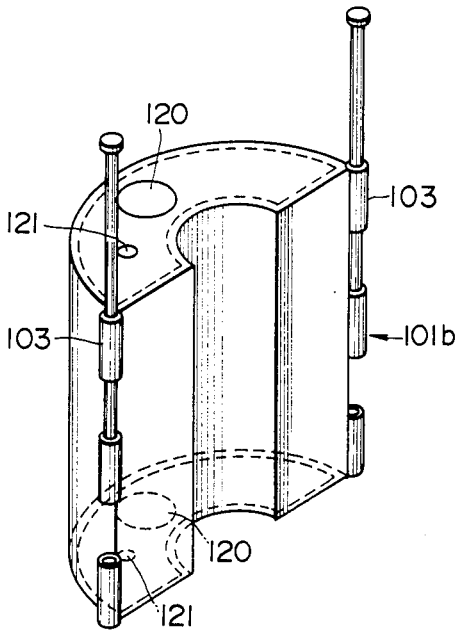
FIG. 3B is a perspective view of the intermediate unit used in the multistage configuration shown in FIG. 3A.

The intermediate unit 101*b* is shaped into a semicylindrical form as shown in FIG. 3B. Each of the top cover and the bottom plate has a chemicals communication opening 120 and a hole 121. The intermediate unit 101*b* is placed in communication with the upper unit 101*b* and the lower unit 101*c* by the opening 120. The hole 121 is formed to allow the cord 107 to extend through the unit. The intermediate unit is coupled to the other units 101*a* and 101*b* by conventional means (not shown) to control the amount of conveyance.

Figure 4:
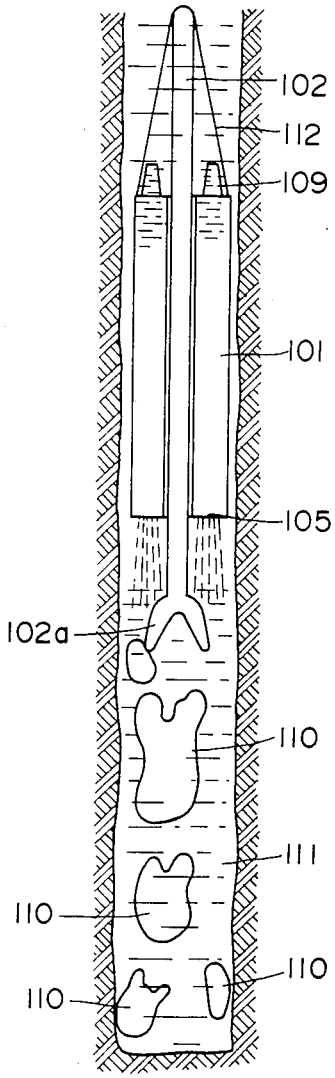
FIG. 4 is a view showing the manner in which a drilling rod is operated.

The manner in which the capsule 101 constructed as described above is used is now described by referring to FIG. 4. Since the chemicals 110 are diffused without removing the drilling rod 102, if the chemicals 110 reacted with the slime at the bottom and solidified, then rotation of the drilling knife edges would be hindered. Accordingly, the rod 102 is first raised to a certain height as shown. Then, the capsule 101 is let down. The chemicals 110 are caused to spread at the certain height above the bottom of the hole, and then drop as a mass toward the location of lost circulation. Finally, the mass solidifies, but no problems occur in restarting the knife edge 102*a* of the rod 102. The edge 102*a* also acts as stopper for the decending capsule 101. In this example, chemicals can be conveyed without the need to pull away the drilling rod. In this way, chemicals are easily and rapidly handled. This is quite advantageous in practice.

Figure 5A:
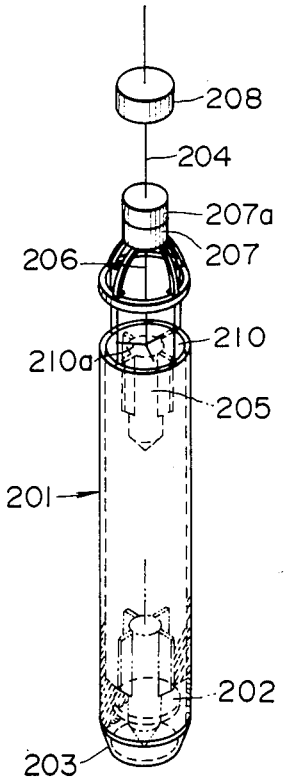
FIG. 5A is a perspective view of a further capsule according to the invention.
Figure 5B:
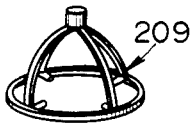
FIG. 5B is a perspective view of the suspension member of the shown in FIG. 5A.
Figure 5C:
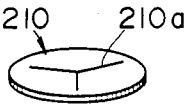
FIG. 5C is a perspective view of the cover of the capsule shown FIG. 5A.
Figure 5D:
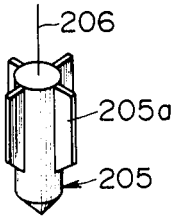
FIG. 5D a perspective view of the weight of the capsule shown in FIG. 5A.

Referring next to FIG. 5A, there is shown a yet other capsule according to the invention. The capsule comprises a cylinder 201 that acts as a container charged with chemicals for stopping lost circulation. The lower end of the cylinder 201 tapers off. The cylinder has a bottom plate 202 made from a fragile material such as glass, ceramic, reinforced fabric, or the like. Lead or other substance is placed in the cylinder to prevent the capsule from floating when it enters the water inside the hole. The bottom plate 202 is formed independently of the cylinder 201. The hollow inside of the cylinder 201 has an enlarged portion near its lower end. When the bottom plate 202 is mounted to the cylinder 201, a short threaded cylinder 203 is screwed to the enlarged portion of the cylinder. The short cylinder 203 forms the front end portion of the cylinder 201 to secure a path along which chemicals 2 from the bottom plate 202 are discharged. A weight 205 having wings 205*a* for destroying the bottom plate 202 is suspended by a cord 206 above the bottom plate 202. The position of the weight 205 is so set that it can drop a certain distance. The weight 205 is so dimensioned that its front end is loosely inserted in the short cylinder 203. The wings 205*a* engage the tapering lower end of the cylinder 201. After the weight 205 is used, it remains in the cylinder 201 while assuring a path along which the chemicals are diffused. The protrusions 205*a* also act to accelerate the falling cylinder.

The cylinder 201 is suspended by a wire line 204. A cutting base 207 is rigidly secured to the line 204 so as to form a jaw. The cord 206 is stretched on the base 207 and fixed to one side of the base. A plate 207*a* is pressed against the base 207.

A cylindrical messenger 208 is centrally provided with a hole through which the wire line 204 extends. When the messenger falls along the line 204 from the opening of the borehole, it collides against the cutting base 207, cutting the cord 206. Then, the weight 205 drops to the bottom plate 202, destroying it. Thus, the chemicals are diffused into the hole.

A suspension member 209 is disposed just below the cutting base 207 and interposed between the wire line 204 and the cylinder 201. In this way, the cylinder 201 is suspended like an expanded hand. Consequently, the distance between the cutting base 207 and the cylinder 201 which are heavy can be made short. This stabilizes the cylinder while it is dropping.

A soft cover 210 is made of a soft sheet consisting of silicone rubber or the like. The cover 210 plugs up the upper opening of the cylinder 201, and is provided with slits 210*a* to bring the chemicals and outside drilling mud into direct contact with each other. Thus, the pressure inside the cylinder 201 is balanced against the outside pressure. Hence, it is unlikely that a pressure difference brings about a destruction. The weight 205 is suspended immediately below the cover 210.

Figures 6A, 6B, 6C, 6D:
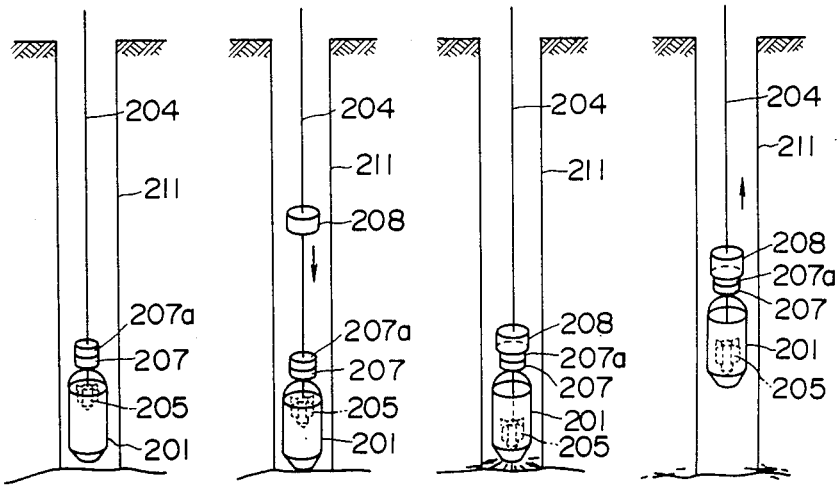
FIGS. 6A—6D are views for illustrating the manner in which the capsule shown in FIG. 5A is used.

The manner in which the chemicals are conveyed by the cylinder 201 is now described by referring to FIGS. 6A–6D. The cylinder 201 is let down to the location of lost circulation while suspended by the wire line 104, as shown in FIG. 6A. Then, the messenger 208 is moved toward the cylinder 201, as shown in FIG. 6B. The cord 206 is cut, and the weight 205 acts on the bottom plate 202. The chemicals are then diffused, as shown in FIG. 6C. Subsequently, the cylinder 201 is withdrawn while the weight 205 is left in the cylinder 201, as shown in FIG. 6D.

This procedure is exactly the same as the procedures already described in connection with FIGS. 1A–1D, 2A–2C, 3A–3B, and 4. In this example, the weight does not get out of the cylinder after it destroys the bottom plate. Therefore, it is not necessary to provide a cord for preventing the weight from getting out of the cylinder. The cord must be so set that it has a certain flexture. Heretofore, various members have been caught by the cord. This problem does not take place.

What is claimed is:

1. A method of conveying chemicals, comprising the steps of:

preparing a capsule which comprises a cylinder and has a bottom plate at its lower end, the capsule being charged with chemicals, the bottom plate being made from a fragile material such as glass, ceramic, or reinforced cloth;

suspending a weight above the cylinder by a cord, the weight being used for destroying the bottom plate;

fastening the cord such that the cord extends over knife edges protruding from a cutting base that is rigidly fixed to a wire line from which the cylinder is suspended;

letting down the capsule to a desired location in a borehole;

slidably attaching a weighted object for cutting the cord to the wire line;

letting the weighted object slide down the wire line causing the cord to be cut by the knife edges, thereby causing the weight to act on the bottom plate to diffuse the chemicals contained in the capsule.

2. A capsule for conveying chemicals through a borehole, comprising:

a hollow cylinder whose inside has an enlarged portion at the lower end;

a bottom plate made from a fragile material such as glass, ceramic, or reinforced cloth, the bottom plate being mounted to the enlarged portion of the cylinder via a short threaded cylinder member;

a weight suspended by a cord above the cylinder, the weight being used for destroying the bottom plate;

a cutting base rigidly fixed to a wire line by which the cylinder is suspended;

knife edges protruding from the cutting base, the cord being fastened so as to extend above the knife edges; and means for causing the cord to be pressed against the knife edges, thereby cutting the cord.

3. A capsule for conveying chemicals through a borehole as set forth in claim 2, wherein the cylinder and the short threaded cylindrical member are made from the same material.

4. A capsule for conveying chemicals through a borehole as set forth in claim 2, wherein an end of the short threaded cylindrical member tapers inwardly.

5. A method of conveying chemicals through a borehole, comprising the steps of:

mounting a capsule on a drilling rod so that the capsule embraces the rod, the capsule being vertically divided into a plurality of sections, the capsule being charged with chemicals for stopping lost circulation, the capsule being annular in a cross section perpendicular to the axis of the drilling rod, the capsule having a bottom plate made from a fragile material;

letting down the capsule along the drilling rod to a desired position in the borehole;

causing a weight to act on the bottom plate to destroy it, thereby diffusing the chemicals.

6. A capsule for conveying chemicals through a borehole, comprising:

a capsule charged with chemicals for stopping lost circulation, the capsule being mounted on a drilling rod so as to embrace the rod, the capsuled being vertically divided into a plurality of sections, the capsule being annular in a cross section perpendicular to the axis of the drilling rod, the capsule having a bottom plate made from a fragile material such as glass, the capsule having a top cover provided with balancer openings therethrough to balance the pressure inside and outside the capsule;

weights for destroying the bottom plate, the weights being suspended in the capsule by cords extending through the balancer openings;

a wireline by which the capsule is suspended;

a cutting base rigidly fixed to the wire line;

knife edges protruding from the cutting base, the cords being fastened so as to extend over the knife edges; and means for causing the cords to be pressed against the knife edges, thereby cutting the cords.

7. A method of conveying chemicals through a borehole, comprising the steps of:

letting down a cylinder to a desired position in the borehole via a wire line, the capsule being charged with chemicals for stopping lost circulation, the lower end of the capsule tapering off, the capsule having a bottom plate made from a fragile material;

causing weights to act on the bottom plate, the weights being suspended above the cylinder, each weight having axially directed fins and being capable of destroying the bottom plate; and diffusing the chemicals and recovering the cylinder while the weights are left and engaged in the cylinder.

8. A capsule for conveying chemicals through a borehole, comprising:

a hollow cylinder whose inside has an enlarged portion at the lower end that tapers off;

a bottom plate made from a fragile material such as glass, ceramic, or reinforced cloth, the bottom plate being mounted to the enlarged portion of the cylinder via a short threaded cylindrical member;

a soft cover mounted at the top of the cylinder and having slits;

a weight for destroying the bottom plate, the weight having axially extending fins and being suspended just below the slits by a cord;

a cutting base rigidly fixed to a wire line by which the cylinder is suspended, the cord being fastened so as to extend above the cutting base; and means for causing the cord to be pressed against the cutting base, thereby cutting the cord.

9. A capsule for conveying chemicals through a borehole as set forth in claim 8, wherein the cylinder and the short threaded cylindrical member are made from the same material.

10. A capsule for conveying chemicals through a borehole as set forth in claim 3, wherein an end of the short threaded cylindrical member tapers inwardly.

11. A capsule for conveying chemicals through a borehole as set forth in claim 2, wherein said means for causing the cord to be pressed against the knife edges comprises a weighted object slidably attached to the wire line.

12. A capsule for conveying chemicals through a borehole as set forth in claim 6, wherein said means for causing the cords to be pressed against the knife edges comprising a weighted object slidably attached to the drilling rod.

13. A capsule for conveying chemicals through a borehole as set forth in claim 8, wherein said means for causing the cord to be pressed against the cutting base comprises a weighted object slidably attached to the wire line.

* * * * *

UNITED STATES PATENT AND TRADEMARK OFFICE

CERTIFICATE OF CORRECTION

PATENT NO. : 4,706,753

DATED : November 17, 1987

INVENTOR(S) : Katsutoshi Ohkochi et al.

It is certified that error appears in the above-identified patent and that said Letters Patent is hereby corrected as shown below:

On the Title Page:

In line 73 Assignee: Takenaka Komuten Co., Ltd. and Sekiso Co., Ltd.

Signed and Sealed this

Seventeenth Day of May, 1988

*Attest:*

DONALD J. QUIGG

*Attesting Officer*

*Commissioner of Patents and Trademarks*